US006104906A

United States Patent [19]

Horikoshi

[11] Patent Number: 6,104,906

[45] Date of Patent: Aug. 15, 2000

[54] BLADE DEVICE AND FIXING APPARATUS HAVING THE SAME

[75] Inventor: Jun Horikoshi, Yokohama, Japan

[73] Assignee: Canon Kabushiki Kaisha, Tokyo, Japan

[21] Appl. No.: 09/267,705

[22] Filed: Mar. 15, 1999

[30] Foreign Application Priority Data

Mar. 19, 1998 [JP] Japan ..... 10-089604

[51] Int. Cl.[7] ..... G03G 15/20; G03G 21/00

[52] U.S. Cl. ..... 399/326; 399/351

[58] Field of Search ..... 399/273, 283, 399/326, 327, 350, 351

[56] References Cited

U.S. PATENT DOCUMENTS

| | | | |
|---|---|---|---|
| 3,759,220 | 9/1973 | Saito et al. | 399/350 X |
| 4,043,659 | 8/1977 | Wilson | 399/350 X |
| 4,261,289 | 4/1981 | Bock | 399/273 X |
| 4,521,098 | 6/1985 | Hosoya et al. | 399/283 |
| 5,212,521 | 5/1993 | Ogawa et al. | 399/350 X |

*Primary Examiner*—Fred L. Braun
*Attorney, Agent, or Firm*—Fitzpatrick, Cella, Haper & Scinto

[57] ABSTRACT

A blade device includes an elongated elastic blade, and a support member, disposed along a longitudinal direction of the elastic blade, for supporting one end of the elastic blade in a direction perpendicular to the longitudinal direction. Lateral end sections of the elastic blade in the longitudinal direction are more protruded than a central section thereof in a direction opposite to the support member. Portions of the support member corresponding to protruded portions of the elastic blade and supporting the elastic blade are retracted toward a direction opposite to a protruding direction of the elastic blade. The support member may be made of different shapes to achieve the retracted configuration. In addition, the support member may be made of two different materials so that portions of the support member have different elasticities.

22 Claims, 6 Drawing Sheets

BLADE DEVICE AND FIXING APPARATUS HAVING THE SAME

BACKGROUND OF THE INVENTION

1. Field of the Invention

The present invention relates to a fixing apparatus applied to an image forming apparatus such as a copying machine, a printer and the like, and more particularly, it relates to a blade device applied to such a fixing apparatus.

2. Related Background Art

Generally, in conventional fixing apparatuses, while a recording medium bearing a non-fixed image thereon is being passed through a nip between a fixing member and a pressurizing member which are pressure-contacted with each other, the recording medium is thermally treated by heating means for generating heat by an electric power supplied from a commercial power source.

Residual matters may occur on the fixing member and the pressurizing member, and, particularly, the residual matters are apt to occur on the fixing member which are pressure-contacted with a non-fixed image bearing surface of a transfer sheet (recording medium).

To cope with this, in the past, there has been proposed a fixing apparatus having a molding lubricant coating means for coating a molding lubricant capable of improving mold releasing ability of the residual matters from the fixing member on at least one of the fixing member and the pressurizing member, and a coating amount regulating member for regulating a coating amount of the molding lubricant on the fixing member thereby to improve the mold releasing ability of the residual matters from the fixing member.

In the past, as the coating amount regulating member, for example, as shown in FIG. 9, a regulating blade 100 is already known and has been put to practical use. Incidentally, FIG. 9 is a front view showing a schematic construction of the regulating blade 100.

The regulating blade 100 comprises a thin plate-shaped support member 101 consisting essentially of metal such as iron, and a rubbing member 102 for regulating an amount of molding lubricant on the fixing member by rubbing the fixing member.

In the support member 101, at a side on which the rubbing member contacts with the fixing member, i.e., at a rubbing member 102 side end, along a direction perpendicular to a longitudinal direction of the regulating blade 100, widths w (for supporting the rubbing member 102) of both lateral end sections 101A are substantially the same as a width w (for supporting the rubbing member 102) of a central section 101B.

Further, the support member 101 has one end (in the direction perpendicular to the longitudinal direction) supported by a body of the fixing apparatus and the other end (in the direction perpendicular to the longitudinal direction) secured to the rubbing member 102, so that the support member 101 serves to slidingly contact the rubbing member 102 to the fixing member by applying stress generated by flexion of the support member 101 itself to the rubbing member 102.

In the rubbing member 102, at an end opposite to a side secured to the support member 101, both lateral end sections 102A are more protruded than a central section 102B.

That is to say, by slidingly contacting both lateral end sections 102A (having a free length LB) and the central section 102B (having a free length LC) to the fixing member by the support member 101, excessive molding lubricant is removed from the fixing member and both lateral end portions 102 of the rubbing member 102 can prevent the molding lubricant flowed along an edge of the rubbing member 102 in the longitudinal direction from leaking.

Thus, in the conventional art, the rubbing member 102 is slidingly contacted to the fixing member by the stress generated by the flexion of the support member 101 so that the coating amount of the molding lubricant on the fixing member is regulated by removing the excessive molding lubricant from the fixing member while slidingly contacting the rubbing member 102 to the fixing member.

However, in the regulating blade 100, the widths w of the both lateral end sections 101A of the support member 101 are substantially the same as the width w of the central section 101B.

Thus, if the rubbing member 102 is intended to abut against the fixing member, even when the central section 102B of the rubbing member 102 abuts against the fixing member, sections 102C adjacent to both lateral end sections 102A are floating from the fixing member by the influence of the both lateral edge sections 102A.

Therefore, in order to also make the sections 102C abut against the fixing member properly, a force for bending the both lateral end sections 102A is further required. However, due to the presence of such a force, the central section 102B already abutting against the fixing member is subjected to a further force.

As a result, a sliding contact force between the central section of the rubbing member and the fixing member is increased, with the result that the rubbing member is apt to be worn and the service life of the rubbing member is shortened.

SUMMARY OF THE INVENTION

An object of the present invention is to provide a blade device and a fixing apparatus having such a blade device, in which contact pressure of an elastic blade is decreased to lengthen the service life of the elastic blade.

Another object of the present invention is to provide a blade device and a fixing apparatus having such a blade device, in which an end (for supporting an elastic blade) of a support member has a convex shape wherein a longitudinal central section of the end of the support member is more protruded toward the elastic blade than both lateral end sections of the support member.

A further object of the present invention is to provide a blade device and a fixing apparatus having such a blade device, in which elasticity of both lateral end sections of a support member for supporting an elastic blade is smaller than that of a central section of the support member.

The other objects and features of the present invention will be apparent from the following detailed explanation of the invention.

DESCRIPTION OF THE PREFERRED EMBODIMENTS

The present invention will now be explained in connection with embodiments thereof with reference to the accompanying drawings.

First of all, an embodiment of the present invention will be explained with reference to FIGS. 1 to 7.

Figure 1:
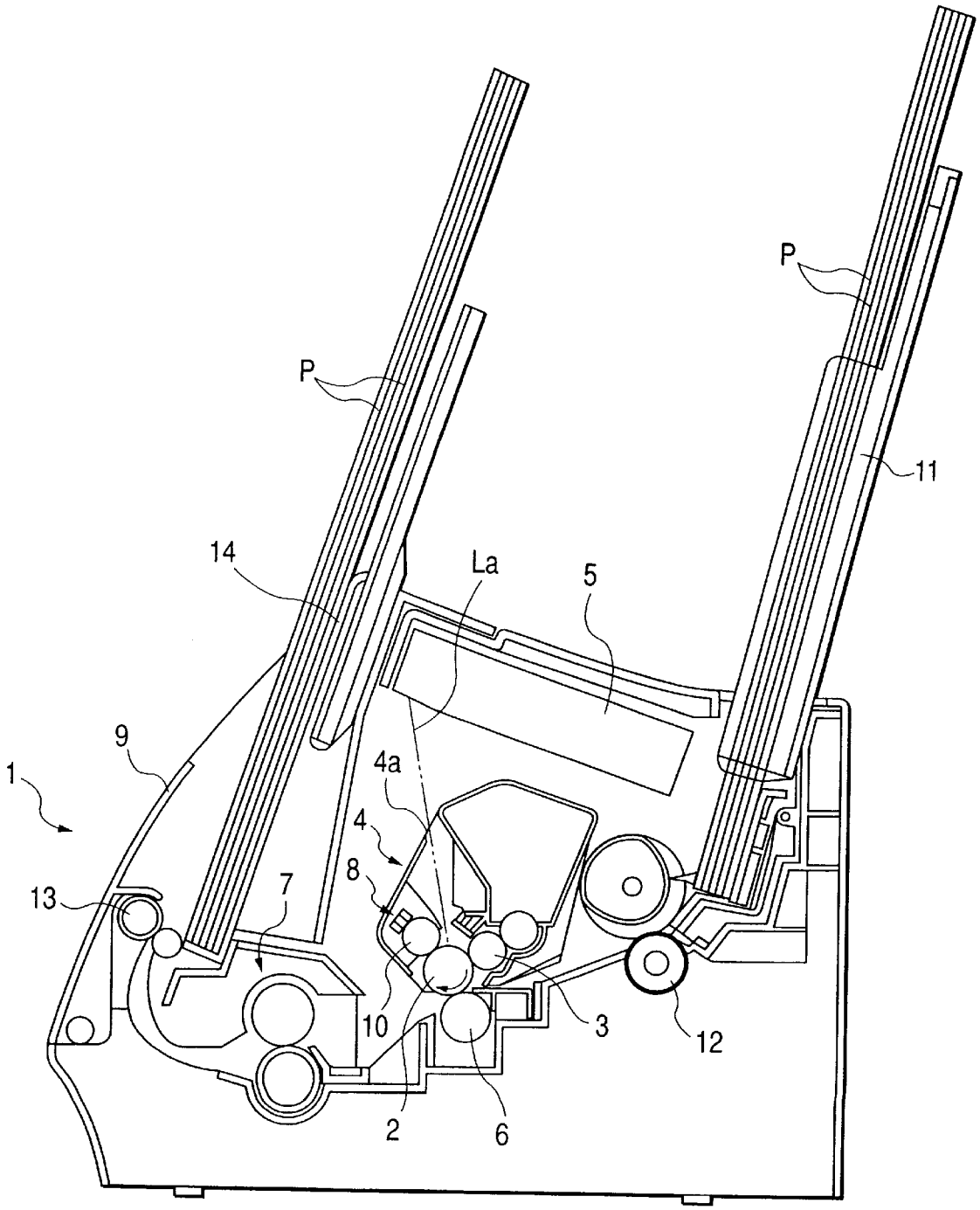
FIG. 1 is a sectional view of an image forming apparatus to which the present invention is applied.

FIG. 1 is a schematic sectional view showing a schematic construction of an electrophotographic laser beam printer (referred to merely as "printer" hereinafter) 1 as an image forming apparatus according to the embodiment of the present invention.

The printer 1 is an image forming apparatus of the type in which a series of image forming processes for forming an image on a sheet-shaped recording material P in response to image information provided from an image information providing device (not shown) such as a host computer disposed externally of the printer 1 are performed by a well known electrohphotographic system.

As shown in FIG. 1, the printer 1 includes a process cartridge 4 holding a drum-shaped rotatable image bearing member (photosensitive drum) 2 and a developing device 3, a laser scanner unit (referred to merely as "scanner" hereinafter) 5 for forming an electrostatic latent image corresponding to the image information on an outer peripheral surface of the image bearing member 2 by exposure process in accordance with the image information from the image information providing device, a roll-shaped rotatable transfer member 6 for effecting a transfer process regarding the recording material P, and a fixing apparatus 7 for effecting a fixing process with heat and pressure regarding the recording material P to which the image was transferred.

The process cartridge 4 also holds a primary charging mechanism 8 for charging the outer peripheral surface of the image bearing member 2 to a regulated potential distribution prior to the exposure process of the scanner 5, in addition to the image bearing member 2 and the developing device 3, and is removably supported by a body of the printer 1, so that, when repair of the image bearing member 2 and/or maintenance such as replenishment of a developing agent (developer) to the developing device 3 is required, after a cover 9 which is openably and closably supported by the body of the printer 1 is opened, the entire process cartridge 4 can be exchanged for a new one, thereby performing the maintenance quickly and easily.

The primary charging mechanism 8 includes a rotatable charge roller 10 adapted to charge the outer peripheral surface of the image bearing member 2 to the regulated potential distribution by applying a regulated bias from the commercial power source to the roller prior to the exposure process of the scanner 5. The charge roller 10 is contacted with or slightly spaced apart from the outer peripheral surface of the image bearing member 2.

In the scanner 5, a charged area on the outer peripheral surface of the image bearing member 2 is scanned and exposed by laser La corresponding to time-series electric digital pixel signals of the image information from the image information providing device, through a window 4*a* formed in a body of the process cartridge 4, thereby forming the electrostatic latent image corresponding to the image information on the outer peripheral surface.

Next, a series of image forming processes in the printer 1 will be explained.

When a start button (not shown) or the like of the body of the printer 1 is depressed to start the series of image forming processes in the printer 1, the image bearing member 2 is rotated at a regulated peripheral speed in a direction shown by the arrow, with the result that the charge roller 10 to which the regulated bias is applied is rotated on the image bearing member 2, thereby charging the outer peripheral surface of the image bearing member 2 to the regulated potential distribution.

Then, in response to the image information from the image information providing device, the charged area on the outer peripheral surface of the image bearing member 2 is scanned and exposed by the scanner 5 to form the electrostatic latent image corresponding to the image information on the charged area, and then, the electrostatic latent image is visualized by the developing agent (toner) from the developing device 3 as a visualized image. Then, the visualized image is transferred, by the transfer member 6, onto the recording material P supplied from a cassette 11 (capable of containing a predetermined number of sheets of recording materials P and detachably mounted to the body of the printer 1) and conveyed in a predetermined timing or the like to a space between the image bearing member 2 and the transfer member 6 by a rotatable sheet supply roller 12 or the like.

Then, the recording material P on which the image was transferred is subjected to the fixing process in the fixing apparatus 7. Thereafter, the recording material P is discharged out of the printer 1 by sheet discharge rollers 13 rotatably supported by the body of the printer 1 and is rested on a tray 14 attached to one side of the body of the printer 1. In this way, the series of image forming processes are completed.

Figure 2:
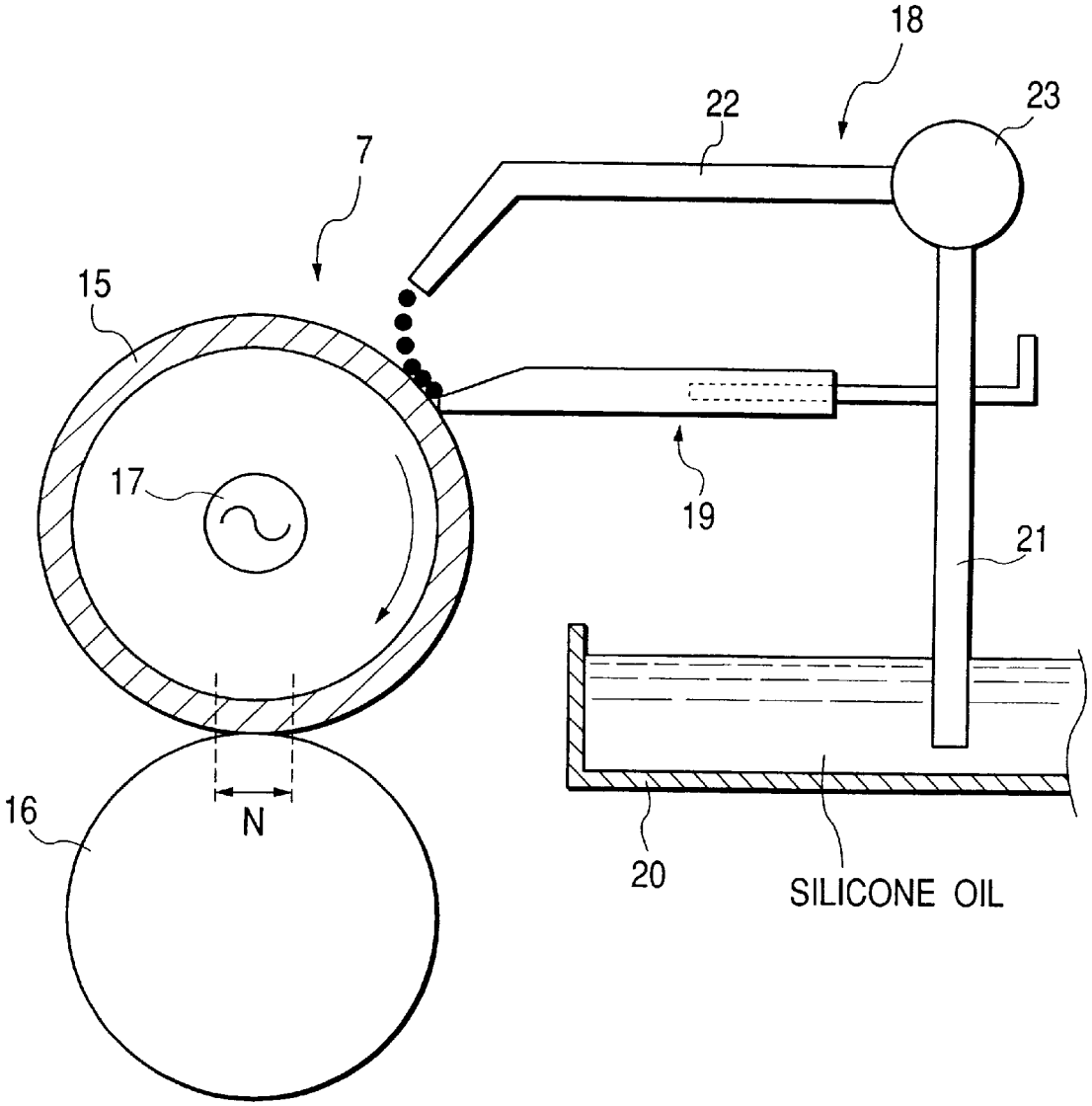
FIG. 2 is a schematic view of a fixing apparatus on which an oil coating mechanism is mounted.

Next, the fixing apparatus 7 will be explained with reference to FIG. 2. FIG. 2 is a schematic sectional view of the fixing apparatus 7.

As shown in FIG. 2, the fixing apparatus 7 comprises a cylindrical or substantially cylindrical rotatable fixing roller (fixing member) 15, a cylindrical or substantially cylindrical rotatable pressurizing roller (pressurizing member) 16, a heater (heating means) 17, an oil coating mechanism (molding lubricant coating means) 18, and a regulating blade (coating amount regulating member) 19.

The fixing roller 15 is rotated in a clockwise direction by a driving force from a drive mechanism (not shown) disposed outside of the fixing apparatus 7, and the heater 17 is disposed within a hollow space in the fixing roller 15 along an axial direction of the fixing roller 15.

The pressurizing roller 16 is pressure-contacted with the fixing roller 15 by a pressurizing mechanism (not shown) disposed outside of the fixing apparatus 7. The recording material bearing a non-fixed image thereon can pass through a nip N between the fixing roller 15 and the pressurizing roller 16 which are pressure-contacted with each other.

The heater 17 is heated by a commercial power source (not shown) disposed outside of the fixing apparatus 7, so that a target temperature of the nip N can be achieved and maintained by adjusting energization from the commercial power source to the heater 17.

The oil coating mechanism 18 serves to reduce an amount of residual matters on an outer peripheral surface of the fixing roller 15 occurring after the fixing process by coating silicone oil (referred to merely as "oil" hereinafter) which is a kind of molding lubricant on the outer peripheral surface of the fixing roller 15.

To this end, the oil coating mechanism comprises an oil pan 20 capable of storing a predetermined amount of oil, and a pump 23 for dropping the oil onto the outer peripheral surface of the fixing roller 15 through a pipe 22 after the oil is pumped from the oil pan 20 through a pipe 21.

As shown in FIG. 2, the regulating blade 19 is slidingly contacted with an area at a downstream side (in a clockwise direction) of the oil dropping point on the outer peripheral surface of the fixing roller 15. Excessive oil removed from the outer peripheral surface of the fixing roller 15 by the regulating blade 19 is returned to the oil pan through a back surface (upper surface) of the regulating blade 19, thereby reducing an amount of oil consumption.

Figure 3:
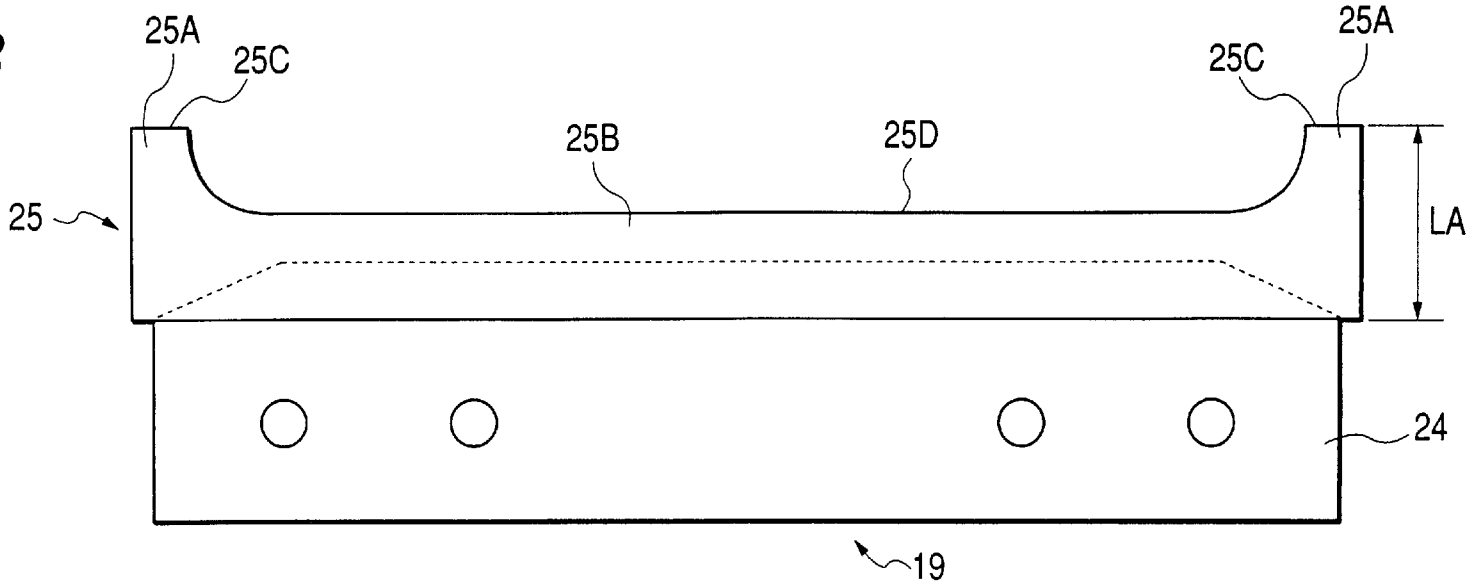
FIG. 3 is a view showing a blade device according to an embodiment of the present invention.

FIG. 3 shows a blade device according to an embodiment of the present invention.

As shown in FIG. 3, the regulating blade 19 or the blade device has a support member 24 consisting essentially of metal such as iron, and a rubbing member (elastic blade) 25 consisting essentially of elastic material such as fluororubber and slidingly contacted with the outer peripheral surface of the fixing roller 15 to regulate the oil coating amount on the outer peripheral surface. In the illustrated embodiment, the support member 24 is formed from an iron plate having a thickness of about 1 mm.

Figure 4:
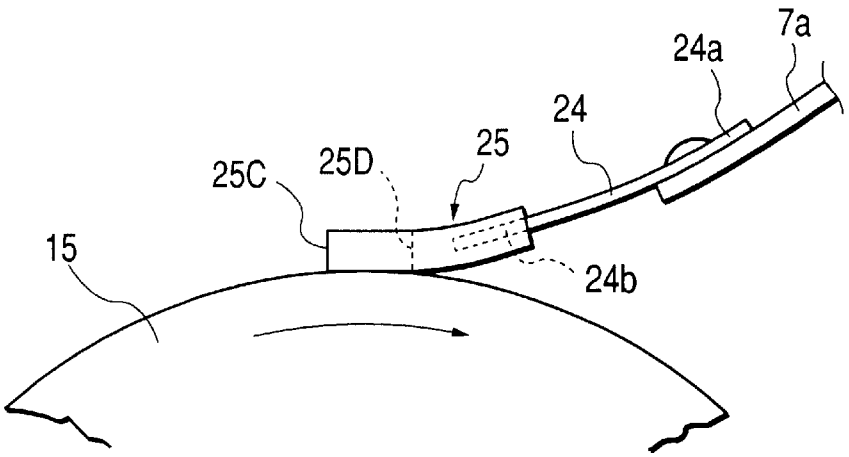
FIG. 4 is a view showing a condition that the blade device is contacted with a fixing roller.

Incidentally, FIG. 3 is a schematic front view showing a schematic construction of the regulating blade 19, and FIG. 4 is a view showing a condition that the regulating blade abuts against the fixing roller 15.

As shown in FIG. 4, the support member 24 has one end 24*a* secured to a fixed portion 7*a* on the body side of the fixing apparatus 7, and the other end 24*b* entered into the rubbing member 25 to secure the rubbing member 25 to the support member 24, so that the support member 24 applies stress generated by flexion of the support member itself to the rubbing member 25 to slidingly contact the rubbing member 25 to the outer peripheral surface of the fixing roller 15.

As shown in FIG. 3, in the rubbing member 25, at an end thereof slidingly contacted with the outer peripheral surface of the fixing roller 15, both lateral end sections 25A are more protruded than a central section 25B. The reference numeral 25C denotes blade edges of the protruded both lateral end sections 25A; and 25D denotes a blade edge of the central section 25B.

Due to the presence of both lateral end sections 25A of the rubbing member 25, the oil flowing along a longitudinal direction at the edge 25D of the rubbing member 25 can be prevented from leaking along an axial direction of the fixing roller.

Figure 5:
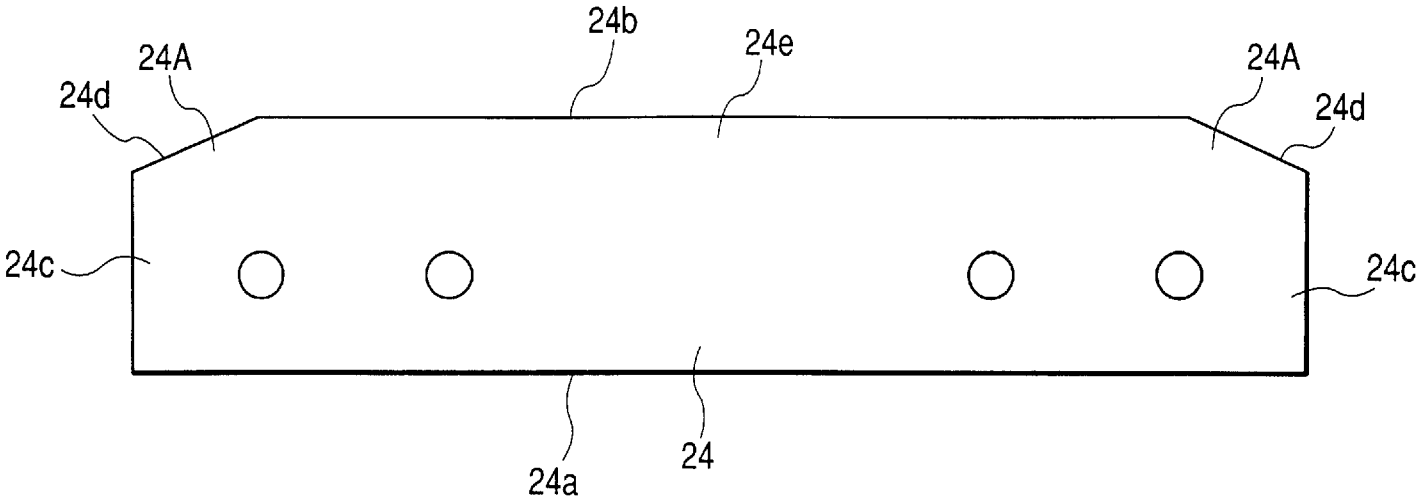
FIG. 5 is a view showing a support member of the blade device.

Further, as shown in FIG. 5, in the support member 24, at an end 24*b* thereof to which the rubbing member 25 is secured, both lateral end sections 24A are obliquely cut so that both lateral end portions (side portions) 24*c* of the support member 24 in the longitudinal direction have inclined portions 24d retracted toward an end opposite to the rubbing member 25. That is to say, the end 24*b* of the support member 24 supporting the rubbing member 25 has a convex shape in which a central section 24*e* in the longitudinal direction is more protruded than the lateral end portions 24*c* toward the rubbing member.

Figure 9:
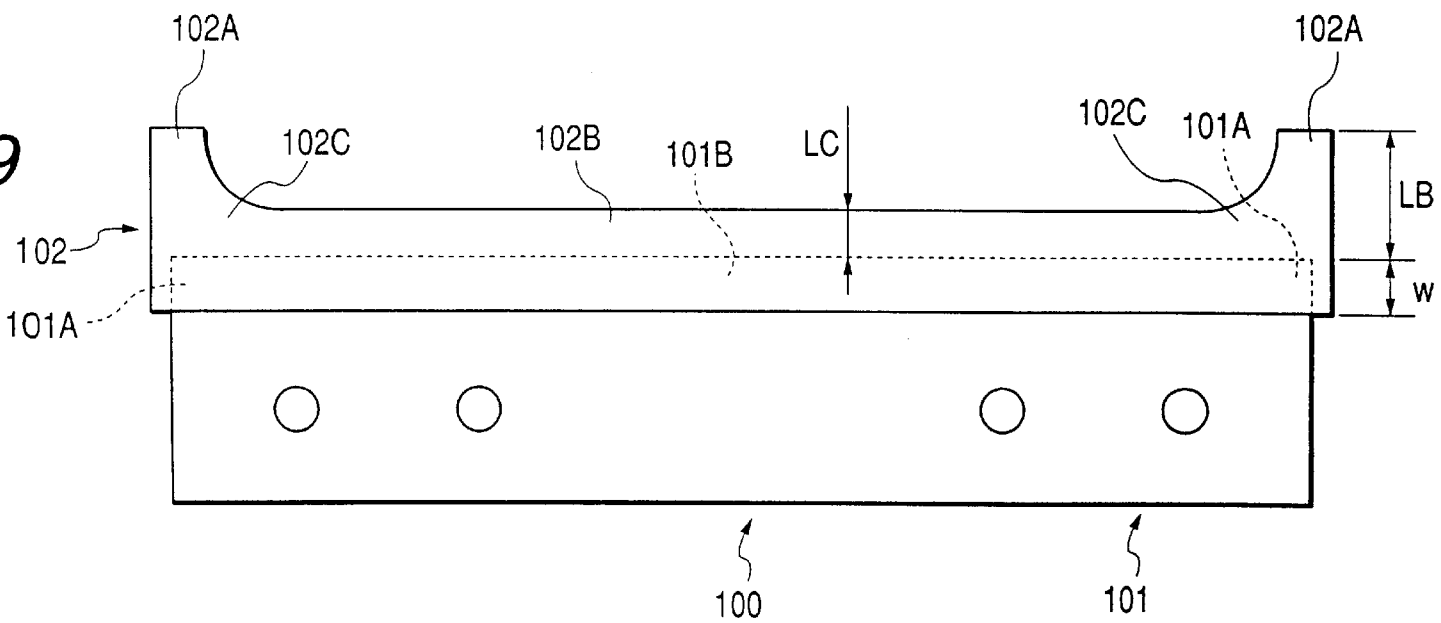
FIG. 9 PRIOR ART
FIG. 9 is a view showing a conventional blade device.

Thus, in the illustrated embodiment, free lengths LA of the both lateral end sections 25A of the rubbing member 25 are sufficiently longer than the free lengths LB shown in FIG. 9.

In this way, in the illustrated embodiment, since both lateral end portions 24*c* of the support member 24 are obliquely cut, the free lengths LA of the protruded lateral end sections 25A of the rubbing member 25 can be lengthened to reduce bending stress of the protruded sections.

Consequently, in the illustrated embodiment, even when the rubbing member 25 having the protruded portions at both lateral end sections 25A for preventing oil leakage is used, since elasticity of the protruded portions is decreased to cause the protruded portions to easily follow the fixing roller, the entire rubbing member can abut against the fixing roller uniformly without applying excessive pressure to the rubbing member 25 (particularly, the central section thereof), thereby preventing excessive strong contact between the rubbing member 25 and the fixing roller 15 to prevent the wear of the rubbing member 25 and to lengthen the service life of the rubbing member.

Incidentally, in the illustrated embodiment, while an example that the both lateral end sections 24A of the support member 24 at the end 24*b* thereof to which the rubbing member 25 is secured are obliquely cut was explained, the shape of the support member 24 is not limited to such an example. For example, shapes of the support members shown in FIGS. 6 and 7 are also effective.

Figure 6:
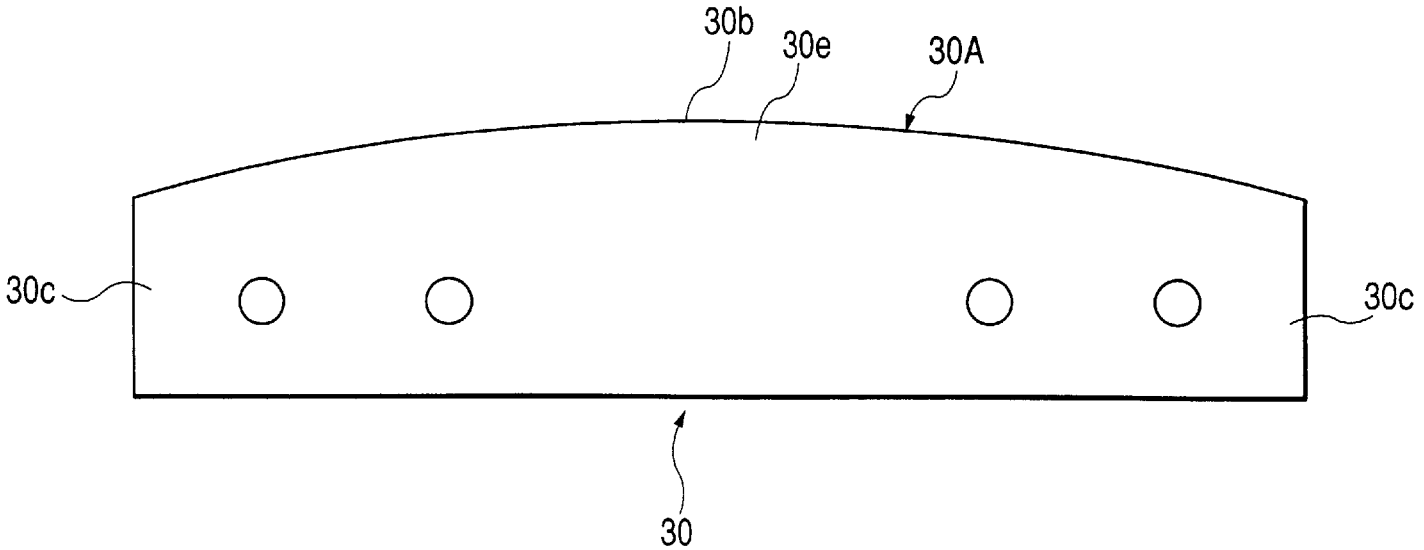
FIG. 6 is a view showing another support member of the blade device.
Figure 7:
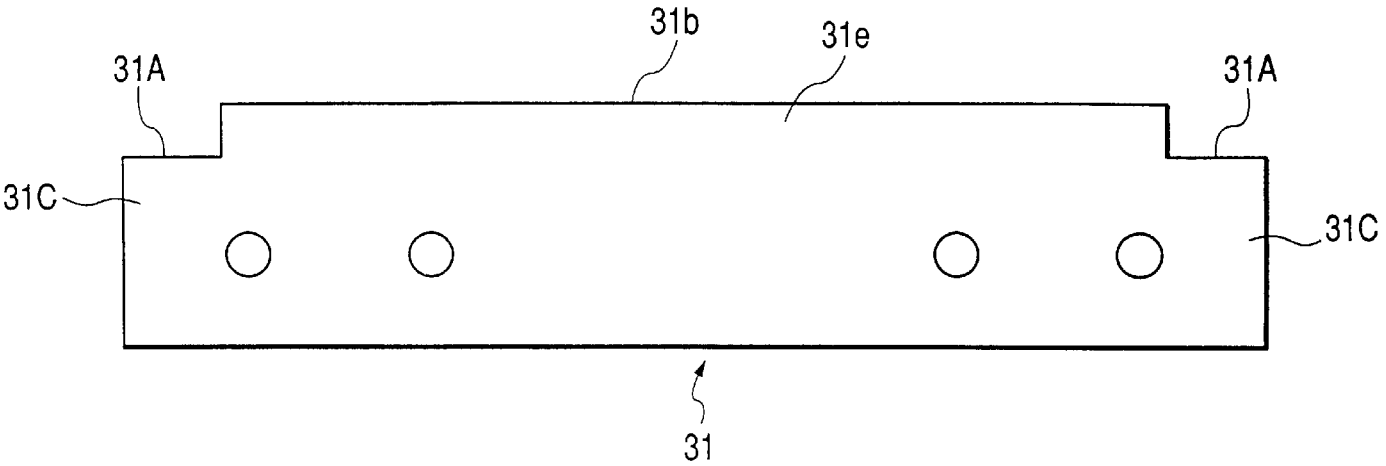
FIG. 7 is a view showing a further support member of the blade device.

Support members 30, 31 shown in FIGS. 6 and 7, respectively, have convex shapes so that, at ends 30*b*, 31*b* of these support members 30, 31 for supporting respective rubbing members, central sections 30*e*, 31*e* in the longitudinal direction thereof are more protruded toward the rubbing members side than both lateral end sections 30*c*, 31*c* thereof.

That is to say, in the support member 30 shown in FIG. 6, the end 30A (30*b*) thereof for supporting the rubbing member is smoothly curved retractively (i.e., in a direction opposite to the rubbing member) from the central section 30*e* (in a longitudinal direction) to the both lateral end sections 30*c*, and, in the support member 31 shown in FIG. 7, the both lateral end sections 31*c* in the longitudinal direction thereof have stepped portions 31A retracted in a direction opposite to the rubbing member.

Next, another embodiment of the present invention will be explained with reference to FIGS. 8A and 8B. Incidentally, since a schematic construction of a fixing apparatus according to this embodiment is similar to the fixing apparatus 7 in the previous embodiment, explanation thereof will be omitted by substituting the description corresponding to FIG. 2.

Figure 8B:
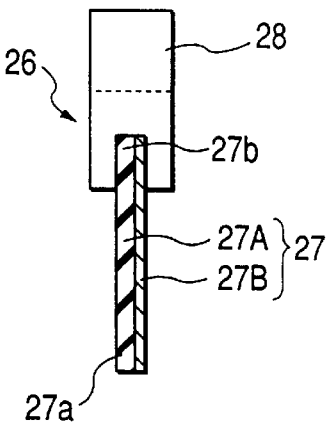
FIG. 8B is a side view of the blade device.
Figure 8A:
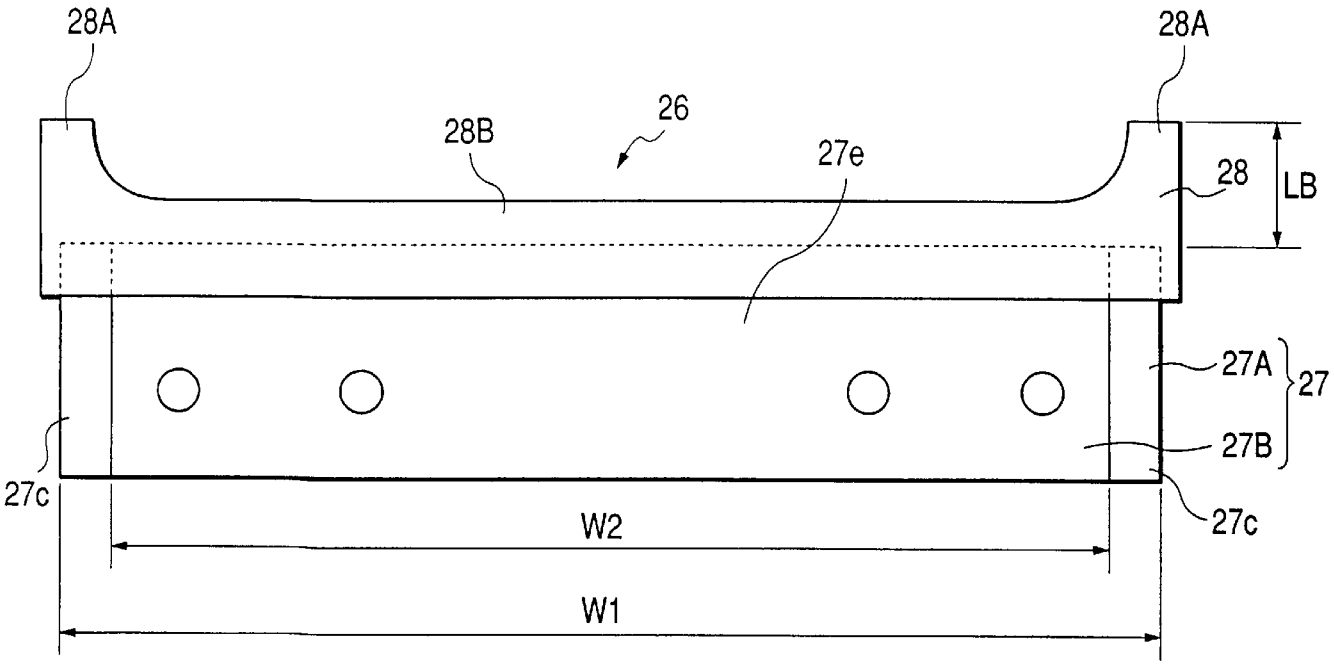
FIG. 8A is a front view showing a blade device according to another embodiment of the present invention.

FIGS. 8A and 8B are views showing a schematic construction of a regulating blade (blade device) 26 which is a preferred example of a coating amount regulating member of this embodiment, and, particularly, FIG. 8A is a schematic front view of the regulating blade 26 and FIG. 8B is a schematic side view of the regulating blade 26.

As shown in FIGS. 8A and 8B, the regulating blade 26 has a support member 27, and a rubbing member (elastic blade) 28 for regulating an oil coating amount on the outer peripheral surface of the fixing roller 15 by slidingly contacting with the outer peripheral surface. In the illustrated embodiment, the elastic blade is made of fluororubber.

The support member 27 has one end 27*a* supported by a body of a fixing apparatus 7 and the other end 27*b* to which the rubbing member 28 is secured, so that the support member 27 applies stress generated by flexion of the support member itself to the rubbing member 28 to slidingly contact the rubbing member 28 to the outer peripheral surface of the fixing roller 15.

As shown in FIG. 8A, in the rubbing member 28, at an end thereof slidingly contacted with the outer peripheral surface of the fixing roller 15, both lateral end sections 28A (in the longitudinal direction) are more protruded than a central section 28B. In this way, oil is-prevented from leaking along the axial direction of the fixing roller 15.

As shown in FIGS. 8A and 8B, the support member 27 is constituted by securing a metallic member 27B consisting essentially of stainless steel or bronze or the like to an elastic member 27A consisting essentially of elastic material such as fluororubber.

In the illustrated embodiment, as shown in FIG. 8A, a length W1 of the elastic member 27A in the longitudinal direction is selected to be greater than a length W2 of the metallic member 27B in the longitudinal direction so that elasticity of both lateral end sections 27*c* in the longitudinal direction of the support member 27 becomes smaller than elasticity of a central section 27*e*, that is to say, at the end 27*b* of the support member 27 to which the rubbing member 28 is secured, the elasticity of the both lateral end sections 27*c* in the longitudinal direction is smaller than the elasticity of the central section 27*e*.

In this way, also in this embodiment, the elasticity of portions corresponding to the protruded portions of the both lateral end sections 28A of the rubbing member 28 can be reduced, with the result that, even when the entire rubbing member abuts against the fixing roller uniformly, the urging pressure can be made relatively small, thereby preventing reduction of the service life of the rubbing member due to wear.

Further, in the illustrated embodiment, since the free length LB of the rubbing member 28 is not changed (the free length can be made the same as that in the conventional case), even when a thickness of the rubbing member 28 is reduced, the rubbing member is not turned over or laid laterally. Thus, by reducing the thickness, an amount of expensive fluororubber can be saved.

Incidentally, in the above-mentioned embodiments, while an example that the coating amount of the molding lubricant on the fixing member is regulated by the coating amount regulating member was explained, in an arrangement in which there are provided a molding lubricant coating means for coating molding lubricant on the pressurizing member and a coating amount regulating member for regulating a coating amount of the molding lubricant on the pressurizing member, by using the above-mentioned embodiments, the same effect and advantage as the above can be obtained regarding the pressurizing member.

The above-mentioned blade device is not limited to the device for regulating the coating amount of oil but may be applied to a cleaning blade device for cleaning the fixing roller.

While the embodiments of the present invention was explained, the present invention is not limited to such embodiments, various alterations and modifications can be made within the scope of the invention.

What is claimed is:

1. A blade device comprising:

an elongated elastic blade; and a support member, disposed along a longitudinal direction of said elastic blade, for supporting one end of said elastic blade in a direction perpendicular to the longitudinal direction;

wherein lateral end sections of said elastic blade in the longitudinal direction are more protruded than a central section thereof in a direction opposite to said support member;

and wherein portions of said support member corresponding to said protruded end sections of said elastic blade and supporting said elastic blade are retracted toward a direction opposite to a protruding direction of said elastic blade.

2. A blade device according to claim 1, wherein said both lateral end sections of said support member in the longitudinal direction have inclined portions retracted in a direction opposite to said elastic blade.

3. A blade device according to claim 1, wherein said end of said support member supporting said elastic blade is smoothly retracted from its central section to its both lateral end sections in a direction opposite to said elastic blade.

4. A blade device according to claim 1, wherein said both lateral end sections of said support member in the longitudinal direction have stepped portions retracted in a direction opposite to said elastic blade.

5. A blade device according to claim 1, wherein said elastic blade is made of rubber.

6. A blade device according to claim 1, wherein said support member is made of metal.

7. A fixing apparatus comprising:

a fixing member for fixing a non-fixed image to a recording material;

an elongated elastic blade contacted with said fixing member; and a support member, disposed along a longitudinal direction of said elastic blade, for supporting one end of said elastic blade in a direction perpendicular to the longitudinal direction;

wherein lateral end sections of said elastic blade in the longitudinal direction are more protruded than a central section thereof in a direction perpendicular to the longitudinal direction;

wherein lateral end sections of said elastic blade in the longitudinal direction are more protruded than a central section thereof in a direction opposite to said support member;

and wherein portions of said support member corresponding to protruded end sections of said elastic blade and supporting said elastic blade are retracted toward a direction opposite to a protruding direction of said elastic blade.

8. A fixing apparatus according to claim 7, wherein said both lateral end sections of said support member in the longitudinal direction have inclined portions retracted in a direction opposite to said elastic blade.

9. A fixing apparatus according to claim 7, wherein said end of said support member supporting said elastic blade is smoothly retracted from its central section to its both lateral end sections in a direction opposite to said elastic blade.

10. A fixing apparatus according to claim 7, wherein said both lateral end sections of said support member in the longitudinal direction have stepped portions retracted in a direction opposite to said elastic blade.

11. A fixing apparatus according to claim 7, wherein said elastic blade is made of rubber.

12. A fixing apparatus according to claim 7, wherein said support member is made of metal.

13. A fixing apparatus according to claim 7, further comprising releasing material coating means for coating a releasing material on said fixing member, and wherein said elastic blade regulates a coating amount of the releasing material on said fixing member.

14. A blade device comprising:

an elongated elastic blade; and a support member, disposed along a longitudinal direction of said elastic blade, for supporting one end of said elastic blade in a direction perpendicular to the longitudinal direction; wherein lateral end sections of said elastic blade in the longitudinal direction are more protruded than a central section thereof in a direction opposite to said support member; and wherein elasticity of both lateral end sections of said support member in a longitudinal direction is smaller than elasticity of a central section thereof.

15. A blade device according to claim 14, wherein said support member has a first and a second members, and said second member is provided in stacked relation on said first member except for lateral end sections of said first member in a longitudinal direction.

16. A blade device according to claim 15, wherein said first member is made of rubber and said second member is made of metal.

17. A blade device according to claim 14, wherein said elastic blade is made of rubber.

18. A fixing apparatus comprising:

a fixing member for fixing a non-fixed image to a recording material;

an elongated elastic blade contacted with said fixing member; and a support member, disposed along a longitudinal direction of said elastic blade, for supporting one end of said elastic blade in a direction perpendicular to the longitudinal direction; wherein lateral end sections of said elastic blade in the longitudinal direction are more protruded than a central section thereof in a direction opposite to said support member; and wherein elasticity of both lateral end sections of said support member in a longitudinal direction is smaller than elasticity of a central section thereof.

19. A fixing apparatus according to claim 18, wherein said support member has a first and a second members, and said second member is provided in an stacked relation on said first member except for lateral end sections of said first member in a longitudinal direction.

20. A fixing apparatus according to claim 19, wherein said first member is made of rubber and said second member is made of metal.

21. A fixing apparatus according to claim 18, wherein said elastic blade is made of rubber.

22. A fixing apparatus according to claim 18, further comprising releasing material coating means for coating a releasing material on said fixing member, and wherein said elastic blade regulates a coating amount of the releasing material on said fixing member.

* * * * *

UNITED STATES PATENT AND TRADEMARK OFFICE

CERTIFICATE OF CORRECTION

PATENT NO. : 6,104,906

DATED : August 15, 2000

INVENTOR(S) : JUN HORIKOSHI

It is certified that error appears in the above-identified patent and that said Letters Patent is hereby corrected as shown below:

ON THE COVER:

[56], "Fitzpatrick, Cella, Haper & Scinto" should read --Fitzpatrick, Cella, Harper & Scinto--.

COLUMN 3:

Line 29, "electrohphotographic" should read --electrophotographic--.

COLUMN 7:

Line 58, "was" should read --were--.

COLUMN 9:

Line 18, "members" should read --member--.

COLUMN 10:

Line 14, "members" should read --member--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*